United States Patent [19]

Hick

[11] Patent Number: 4,677,343

[45] Date of Patent: Jun. 30, 1987

[54] SEALED BEAM LAMPS

[75] Inventor: Kevin Hick, Leicester, England

[73] Assignee: Thorn Emi plc, London, England

[21] Appl. No.: 671,947

[22] Filed: Nov. 16, 1984

[30] Foreign Application Priority Data

Nov. 18, 1983 [GB] United Kingdom ..... 8330774

[51] Int. Cl.[4] ..... H01J 7/44

[52] U.S. Cl. ..... 315/61; 315/60; 315/59; 315/330; 315/73; 315/74

[58] Field of Search ..... 315/61, 59, 60, 335, 315/336, 330, 263, 73, 74

[56] References Cited

U.S. PATENT DOCUMENTS

| | | | |
|---|---|---|---|
| 3,900,753 | 8/1975 | Richardson | 313/198 |
| 4,205,258 | 5/1980 | Ward | 315/73 |
| 4,388,557 | 6/1983 | Shaffer | 315/75 |
| 4,439,707 | 3/1984 | Hattori et al. | 313/130 |
| 4,445,073 | 4/1984 | Wyner et al. | 315/60 |
| 4,465,954 | 8/1984 | Barakitis et al. | 315/73 |

FOREIGN PATENT DOCUMENTS

| | | | |
|---|---|---|---|
| 1185487 | 8/1983 | European Pat. Off. . | |
| 0085487 | 8/1983 | European Pat. Off. . | |
| 2143690 | 3/1973 | Fed. Rep. of Germany . | |
| 0067175 | 6/1977 | Japan | 315/60 |
| 0054468 | 4/1979 | Japan | 315/60 |
| 804319 | 11/1958 | United Kingdom . | |
| 1365648 | 9/1974 | United Kingdom . | |
| 1576097 | 10/1980 | United Kingdom . | |

*Primary Examiner*—David K. Moore
*Assistant Examiner*—Michael Razavi
*Attorney, Agent, or Firm*—Fleit, Jacobson, Cohn & Price

[57] ABSTRACT

A discharge lamp is provided with a starting aid in the form of a loop of conductive wire arranged around the discharge lamp arc tube and a novel spark gap. A conductive element is electrically connected between the loop and an insulating sleeve adapted to form a spark gap by means of the conductive element wrapped around an opening in the insulating sleeve. The opening can be in the form of a drilled hole or slot and the arrangement is particularly useful in the restricted confines of a sealed beam reflector lamp.

11 Claims, 7 Drawing Figures

SEALED BEAM LAMPS

Figure 1:
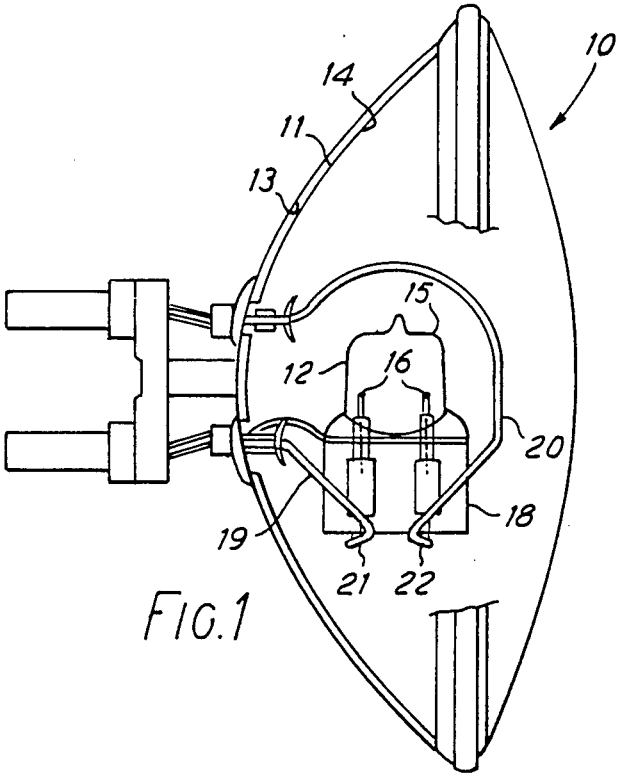

This invention relates to high pressure discharge lamps and to problems in starting such lamps. More particularly the invention is concerned with sealed beam reflector lamps incorporating hot-restrike metal-halide single-ended discharge lamps known as CID (compact iodide daylight) and CSI (compact source iodide).

In our United Kingdom Patent Application No. 82 02526, filed Jan. 29, 1982 we described the problems associated with the starting of high pressure discharge lamps, especially high pressure sodium discharge lamps, and described how these problems can be overcome by the use of a starting aid in combination with a spark gap. Two forms of spark gap are disclosed, both including a glass envelope in which respective electrodes are hermetically sealed and wherein the envelope contains a fill of rare gas or is evacuated.

The problems of starting sealed beam hot-restrike metal halide discharge lamps are somewhat similar to the problems of starting high pressure sodium discharge lamps described in the above mentioned application and the solution proposed therein is applicable. Also as mentioned in that application some photo electric emission can take place between the electrodes at the spark when the spark gap is exposed directly to radiation from the arc tube. Consequently suitable precautions must be taken to prevent this when a spark gap is used as a starting aid. Moreover the problem is exacerbated by the fact that the CID and CSI arc tubes occupy a larger proportion of the internal volume of the sealed beam reflector lamp than does the arc tube in the outer envelope of the high pressure sodium discharge lamp. Consequently accommodating the spark gap within the limited confines of the sealed beam reflector lamp poses problems. If the spark gap is placed in front of the arc tube there is the problem of light obscuration whereas if placed at the rear it may interfere with the reflector bowl. There is also the problem of flash over between in-leads in close proximity to one another.

The re-start the discharge of a hot CID or CSI arc tube a starting pulse of the order 35 KV is required if a starting aid is not used. With a starting aid, for example in the form of a loop around the discharge arc tube in the vicinity of the electrodes, the required pulse drops to about 20 kV. On a cold start 7 kV suffices, however, it would be desirable to use a less expensive ignitor which can supply only 3 kV so that it would consequently be desirable to reduce the starting pulse still further to 3 kV. Moreover, to provide an inexpensive reflector the bowl is coated with aluminium which then has to be protected from flashover in the vicinity of the in-leads when a high voltage starting pulse is applied.

An object of this invention is to provide a form of spark gap which in combination with a starting aid alleviates some or all of the above mentioned problems or which at least assists in achieving some or all of the desired ends when used with discharge lamp arc tubes in confined outer envelopes. A particular object is the alleviation of some of the problems associated with the use of single ended arc tubes when used in sealed beam reflector lamps.

According to the invention there is provided a discharge lamp comprising an outer envelope, an arc tube disposed within the envelope in spaced relationship thereto and having electrodes for sustaining a discharge therebetween, electrical in-leads connected between electrical conductors sealed to said envelope and respective electrodes, the lamp including a starting aid and a spark gap, the spark gap being electrically connected between one of the in-leads and the starting aid by an electrically conductive element wherein the spark gap comprises a predetermined length of insulating material forming a sleeve substantially encircling one of the in-leads, the sleeve serving to space the conductive element from the in-lead to provide said spark gap.

According to a further aspect of the invention there is provided a sealed beam lamp comprising an outer envelope including a reflector bowl, an arc tube disposed within the outer envelope in spaced relationship thereto having electrodes for sustaining a discharge therebetween, electrical in-leads connected to respective electrodes and annular sleeves of insulating material placed around the in-leads adjacent the bowl, the lamp including a starting aid and a spark gap, the spark gap being electrically connected between one of said in-leads and the starting aid by an electrically conductive element wherein the sleeve of said in-lead associated with said conducting element is adapted to form a gapped spacer between the conductive element and said in-lead thereby providing said spark gap.

Figure 3:
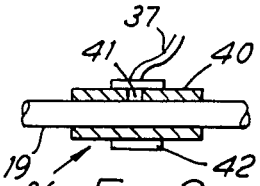
Figure 4:
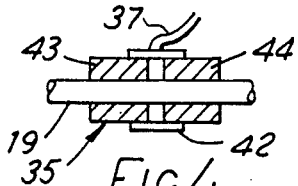
Figure 5:
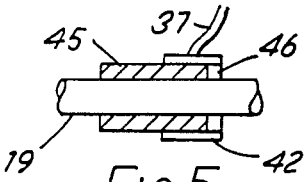
Figure 2:
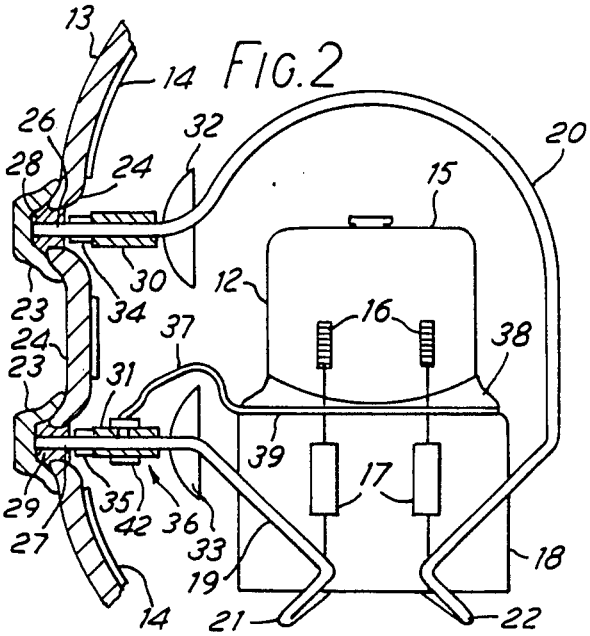
Figure 6:
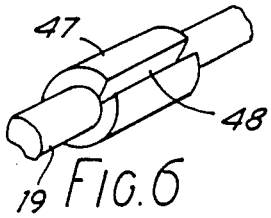

The invention will now be described, by way of example only, with reference to the accompanying drawings wherein:

FIG. 1 is a front part sectional elevation of a sealed beam reflector lamp according to one embodiment of the invention, FIG. 2 is a part sectional elevation of a detail of the lamp of FIG. 1 shown to a larger scale, FIG. 3 shows a preferred form of spark gap for use in the lamp of the invention, FIG. 4 is an alternative form of spark gap for use in the lamp of the invention, FIG. 5 is another form of spark gap for use in the lamp according to the invention, and FIG. 6 is yet another form of spark gap for use in the lamp according to the invention.

Figure 7:
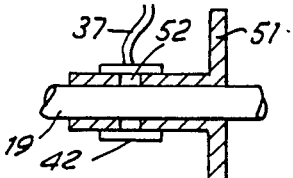

FIG. 7 is a further form of spark gap for use in the lamp according to the invention.

In FIG. 1, the reference numeral 10 depicts generally a sealed beam reflector lamp comprising a reflector bowl 11 in which is situated a single ended high pressure 1 kW hot re-strike metal halide (CID) discharge arc tube 12. The reflector bowl 11 comprises an 8" diameter glass envelope 13 and to provide an inexpensive reflector bowl a coating 14 of aluminium is applied to the glass envelope. In a hot re-strike lamp a dichroic coating is preferred because of its insulating properties.

The discharge arc tube 12 comprises an arc tube envelope 15 in which are inserted tungsten electrodes 16 between which the discharge takes place in an atmosphere of mercury vapour and metal halide additives. Electrodes 16 are connected by way of foils 17 hermetically sealed within pinch seal 18, to respective in-leads 19, 20. The in-leads are bent over on themselves at 21, 22 to grip both flat major sides of the pinch seal 18 and support the arc tube 12 in spaced relationship to the reflector bowl 11. The arrangement of the in-leads 19, 20 is shown in greater detail in FIG. 2 and to a larger scale. Metal ferrules 23 are hermetically fused to glass protuberances 24 formed on the rear of the glass envelope 13 and the ends 26, 27 of the in-leads 19, 20 are secured to the ferrules by brazing at 28, 29. Flashover between ends 26, 27 of the in-leads 19, 20 and the aluminium coating 14 is prevented by insulating quartz sleeves 30, 31 located on the in-leads 19, 20 and held between heat shields 32, 33 and metal tape 34, 35 wound around the ends 26, 27 of the in-leads 19, 20. Dished nickel heat shields 32, 33 are provided to protect the sensitive seal area from the heat of the discharge. One of the insulating sleeves 31 is adapted to form a spark gap 36 which is connected to electrical conducting element 37 to a starting aid 38 formed, in this case, by a loop of conducting material 39 substantially encircling the arc tube 12 in the vicinity of the electrodes 16. The quartz sleeve can be adapted in a variety of ways, however, the essential requirement is that it forms a spacer member providing a gap between one of the electrical lead-in members and the electrically conducting member connected to the starting aid. In this way electrical isolation is maintained until a voltage pulse high enough to spark across the gap is produced whereupon current is carried to the loop of the starting aid.

Different methods of forming the spark gap are shown in FIGS. 3, 4, 5 and 6, however, the preferred method is shown in FIG. 3. This comprises quite simply a cylindrical insulating sleeve 40 of quartz having a single hole 41 drilled through the wall of the sleeve 40. The hole 41 is covered by a metal tape or foil 42 surrounding the quartz sleeve 19 which in turn is connected via electrically conducting element 37 to the starting aid 38. In this case the quartz sleeve completely surrounds the in-lead except for the hole 41.

In FIG. 4 the spark gap is formed by two separate sleeves 43, 44, surrounding the in-lead 19 and maintained a distance apart by conductive metal tape or foil 42. The metal tape 42 is attached by electrically conducting element 37 to the starting aid 38.

In FIG. 5 the single quartz sleeve 45 surrounds the in-lead 19. The spark gap is formed by ensuring the metal tape or foil 42 juts some way past the end face 46 of the sleeve 45. Conducting element 37 is attached to the starting aid 38.

In FIG. 6 the quartz sleeve 47 has a longitudinal cut 48 making it easy to slip over the diameter of the in-lead 19. The foil or tape 42 is then wrapped around outer periphery of the sleeve 47 while the inner periphery of the sleeve 47 substantially surrounds the in-lead 19.

In FIG. 7 there is shown a sleeve 50 of ceramic material joined to a heat shield comprising a flat annular disc 51, also of ceramic material. This forms an integral spark gap and heat shield so that separate heat shield 33 may be omitted. A hole 52 formed in the sleeve 50 is covered by metal tape 42 which is attached by electrically conducting element 37 to the starting aid as described above. A similar arrangement without a spark gap may be used to replace shield 32 and sleeve 30.

In one embodiment of the invention, for example, a 1 kW CSI arc tube in an 8" diameter aluminium coated reflector bowl, the in-leads are stainless steel (Nimonic 90), approximately 2 mm in diameter. The spark gap comprises a 10 mm length of quartz tubing 4.24 mm outside diameter with a 1 mm diameter drilled hole. The hole is covered with a nickel ribbon 3.5 mm wide by 0.005" thick. The starting aid comprises a length of 3.5 mm wide by 0.005" thick nickel tape wound around the pinch seal of the arc tube.

I claim:

1. A discharge lamp comprising an outer envelope, an arc tube disposed within the envelope in spaced relationship thereto and having electrodes for sustaining a discharge therebetween, electrical in-leads extending continuously between electrical conductors sealed to said envelope and respective electrodes, the lamp including a starting aid and a spark gap, the spark gap being supported by one of said in-leads and being arranged for electrical connection between one of the in-leads and the starting aid by an electrically conductive element wherein the spark gap comprises a predetermined length of insulating material forming a sleeve placed around said one of the in-leads, the sleeve serving to space the conductive element from the in-lead and define an opening to provide said spark gap.

2. A sealed beam lamp comprising an outer envelope including a reflector bowl, a single ended discharge arc tube disposed within the outer envelope in spaced relationship thereto having electrodes for sustaining a discharge therebetween, electrical in-leads extending continuously from the outer envelope to respective electrodes and annular sleeves of insulating material placed around the in-leads adjacent the bowl the lamp including a starting aid and a spark gap, the spark gap being supported by one of said in-leads and being arranged for electrical connection to one of said in-leads and the starting aid by an electrically conductive element wherein the sleeve of said in-lead associated with said conductive element forms a spacer between the conductive element and said in-lead and defines an opening thereby providing said spark gap.

3. A sealed beam lamp according to claim 2 wherein an opening is formed in the insulating sleeve.

4. A sealed beam lamp according to claim 3 wherein the opening defines a hole formed in the wall of the sleeve.

5. A sealed beam lamp according to claim 3 wherein the opening defines a longitudinal slot.

6. A sealed beam lamp according to claim 3 wherein the conductive element includes conductive tape wrapped around the insulating sleeve to cover the opening.

7. A sealed beam lamp according to claim 2 wherein the conductive element includes conductive tape wrapped around one of the insulating sleeves and extending outwards of the end face of the sleeve.

8. A sealed beam lamp according to claim 2 wherein the in-leads serve also to support the arc tube in spaced relationship to the reflector bowl.

9. A sealed beam lamp according to claim 2 wherein the sleeve is joined to an annular shield thereby forming an integrated spark gap and heat shield, the sleeve and the shield being made of ceramic material.

10. A discharge lamp according to claim 1 wherein the discharge lamp comprises a sealed beam lamp including a reflector bowl and wherein the in-leads serve also to support the arc tube in spaced relationship to the reflector bowl.

11. A discharge lamp according to claim 1 wherein the conductive element includes conductive tape wrapped around the insulating sleeve and extending outwards of the end face of the sleeve.

* * * * *